US005949183A

United States Patent [19]

Saita et al.

[11] Patent Number: 5,949,183

[45] Date of Patent: Sep. 7, 1999

[54] COLOR SELECTING MECHANISM OF CATHODE-RAY TUBE AND COLOR SELECTING MECHANISM FRAME THEREOF

[75] Inventors: Koji Saita; Ichiro Utsumi, both of Kanagawa, Japan

[73] Assignee: Sony Corporation, Japan

[21] Appl. No.: 08/941,313

[22] Filed: Sep. 30, 1997

[30] Foreign Application Priority Data

Oct. 1, 1996 [JP] Japan ..... 8-260953

[51] Int. Cl.[6] ..... H01J 29/80

[52] U.S. Cl. ..... 313/407; 313/402; 313/408

[58] Field of Search ..... 313/402, 403, 313/404, 407–408, 461, 477 R; 445/30, 35–37, 46–47

[56] References Cited

U.S. PATENT DOCUMENTS 5,394,051 2/1995 Lerner ..... 313/402
5,631,520 5/1997 Inoue et al. ..... 313/402

*Primary Examiner*—Sandra O'Shea
*Assistant Examiner*—Mack Haynes
*Attorney, Agent, or Firm*—Rader, Fishman & Grauer; Ronald P. Kananen

[57] ABSTRACT

An object of the present invention is to enable production of a flat color selecting mechanism in which no floating of a damper wire is produced, accompanied by flattening of a cathode-ray tube screen. A color selecting mechanism frame over which a color selecting electrode thin plate is stretched is formed so as to have at least one point of inflection between a center portion and end portions of the frame.

10 Claims, 6 Drawing Sheets

COLOR SELECTING MECHANISM OF CATHODE-RAY TUBE AND COLOR SELECTING MECHANISM FRAME THEREOF

BACKGROUND OF THE INVENTION

The present invention relates to a color selecting mechanism for use in a cathode-ray tube and its color selecting mechanism frame for fastening and supporting its color selecting electrode thin plate.

As a color selecting mechanism for a color cathode-ray tube, a color selecting mechanism 1 called aperture grill shown in, for example, FIG. 1, has been well known. This color selecting mechanism 1 comprises a rectangular-shaped metallic frame 6 formed of a pair of supporting members 2, 3 opposed to each other and elasticity applying members 4, 5 which are stretched between ends of the supporting members 2, 3, and a mask member or color selecting electrode thin plate 10, which is stretched over a space between the supporting members 2, 3 and contains a plurality of slit-shaped electron beam passage apertures 9 arranged in one direction or in a horizontal direction with respect to a screen.

The color selecting electrode thin plate 10 is made of a metallic thin plate, and contains a number of narrow belt-shaped grid elements 8 which are arranged at a predetermined pitch in the above-mentioned one direction and slit-shaped electron beam passage apertures 9 which are formed between the neighboring grid apertures and elongated in a vertical direction with respect to the screen. As a result, the grid elements 8 are stretched between the supporting members 2, 3 with a predetermined tension by the elasticity applying members 4, 5.

In the color selecting mechanism 1, a damper wire 12 is stretched along the arrangement direction of the grid elements 8 such that it is in contact with a surface of the color selecting electrode thin plate 10, in order to prevent a vibration of the grid element 8.

The aforementioned color selecting mechanism 1 is produced by the following process.

First of all, a spring holder 13 is welded to each of sides of the supporting members 2, 3 and the elasticity applying members 4, 5 of the frame 6. A metallic plate (ordinarily called STC plate) 18 is welded on the bottom face of each of the elasticity applying members 4, 5 so as to produce bimetal effect. Next, the color selecting electrode thin plate 10 is welded between the supporting members 2, 3 of the frame 6 which oppose each other. At this time, in order to apply a predetermined tension to the color selecting electrode thin plate 10, a pressure is applied to the frame 6 before welding, so as to narrow a distance between the supporting members 2 and 3 in the opposing direction (Y direction) (by using a so-called turnbuckle) and with this condition, welding is performed. After welding, the turnbuckle is released so as to allow to apply the predetermined tension to the color selecting electrode thin plate 10.

After the color selecting electrode thin plate 10 is completely stretched, it is passed through a carbon dioxide gas environmental oven so as to be darkened.

Next, damper springs 14 are respectively mounted onto the elasticity applying members 4 and 5 of the frame 6 which oppose each other and the damper wires 12 are stretched between the damper springs 14 which oppose each other. The damper wires 12 suppress the surface of the color selecting electrode thin plate 10 so as to prevent a vibration of the fine grid elements 8. Finally, a spring 15 for fixing the color selecting mechanism 1 to a panel of the cathode-ray tube body is welded to each of the spring holders 13. As a result, assembly of the color selecting mechanism 1 is completed.

In the conventional color selecting mechanism 1, the plane of each of the supporting members 2, 3 of the frame 6 prior to the assembly or a plane 17 on which the color selecting electrode thin plate 10 is to be welded is subject to cutting so as to secure a curved surface (radius of curvature) of a single radius as viewed from the Y direction. The turnbuckle is applied to the frame 6, the color selecting electrode thin plate 10 is stretched, and then darkening processing is performed. In this case, the curved surface of the welded surface 17 of each of the supporting members 2, 3 after darkening is deviated slightly from the single radius due to distribution of the tension in the color selecting electrode thin plate 10 and so on.

However, the radius of an ordinary cathode-ray tube is about 1,000 mm even if it is larger than ordinary sizes. Thus, even if there is any deviation, the plane of the stretched color selecting electrode thin plate 10 draws an outwardly arc across its entire range. As a result, the damper wires 12 are firmly in contact with each of the grid elements 8 thereby preventing a vibration of the grid elements 8 of the color selecting electrode thin plate 10.

Recently, accompanied by a trend in which the screen of the cathode-ray tube has been flattened, the radius of curvature of the plane of the color selecting mechanism 1 has been becoming very large. In a case when the radius of the plane of the supporting members 2, 3 in a frame unit (raw frame 6 before the color selecting electrode thin plate 10 is stretched) of a cathode-ray tube of 66 cm in screen size is a single radius of 15,000 mm, after assembly, the radius of the color selecting mechanism 1, thus the radius of the color selecting electrode thin plate 10 is about 8,000 mm.

As a result of measuring the radius of the plane of this color selecting electrode thin plate 10 in detail, as shown in FIG. 2, it is found that the radius thereof is increased gradually from the center portion toward the end portion in the X direction. In FIG. 2, the axis of abscissa indicates a distance (mm) in the X direction of the screen and the axis of ordinate indicates a distance (mm) in the Z direction assuming that the center of the surface of the supporting members 2, 3 is 0. As evident from FIG. 3, the differential value of this curved line indicates that there are points of inflection a in the vicinity of X=±220 mm. This means that the damper wire 12 is not in contact with the surface of the color selecting electrode thin plate in the vicinity of that point a, thereby indicating that there is no damper wire effective at all.

SUMMARY OF THE INVENTION

Accordingly, in view of such aspects it is an object of the present invention to provide a color selecting mechanism for a cathode-ray tube capable of coinciding with a trend of flattening of the screen thereof, and a frame of the color selecting mechanism.

According to the present invention, there is provided a cathode-ray tube color selecting mechanism comprising a frame, wherein a plane of the frame on which a color selecting electrode thin plate is to be attached, is formed in the form of a curved surface having at least one point of inflection between the center portion and the end portions thereof.

According to the present invention, the color selecting mechanism is so constructed that the color selecting electrode thin plate is stretched over a surface of the aforementioned frame and after darkening, the plane of the frame has a single radius of curvature or similar curvatures thereto.

Further, according to the present invention, the frame is formed in the form of a curved surface having at least one point of inflection between the center portion and the end portions of a plane, on which the color selecting electrode thin plate is fixed. The color selecting electrode thin plate is stretched on this frame and subjected to darkening. As a result, the plane of the frame is produced so as to have a curved surface having a single radius of curvature or curvatures similar thereto. Thus, when this frame is applied to the flattened color selecting mechanism, the damper wire is securely in contact with the entire surface of the color selecting electrode thin plate, thereby preventing a vibration. Thus a high reliability flattened color selecting mechanism can be obtained.

DETAILED DESCRIPTION OF THE PREFERRED EMBODIMENT

A frame for a color selecting mechanism according to the present invention is a frame on which a color selecting electrode thin plate is stretched. This frame is structured in the form of a curved surface having at least one point of inflection in a distance from a center of a surface on which the color selecting electrode thin plate is attached, to end portions thereof.

In the color selecting mechanism according to the present invention, a color selecting electrode thin plate is stretched over a plane of the aforementioned frame. After darkening, the plane of the frame is formed so as to have a curved surface with a single curvature or curvatures similar thereto.

Hereinafter, an embodiment of the present invention will be described with reference to the accompanying drawings.

Figure 4A:
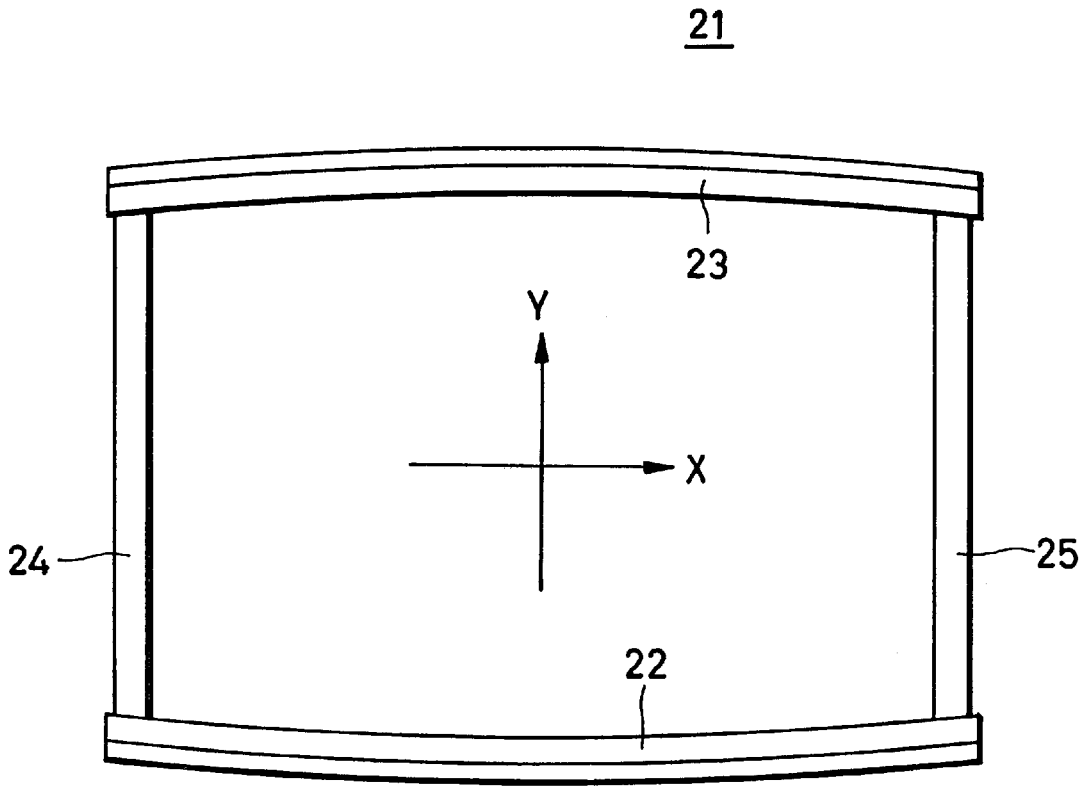
FIG. 4A is a plan view showing an example of the color selecting mechanism frame according to the present invention.
Figure 4B:
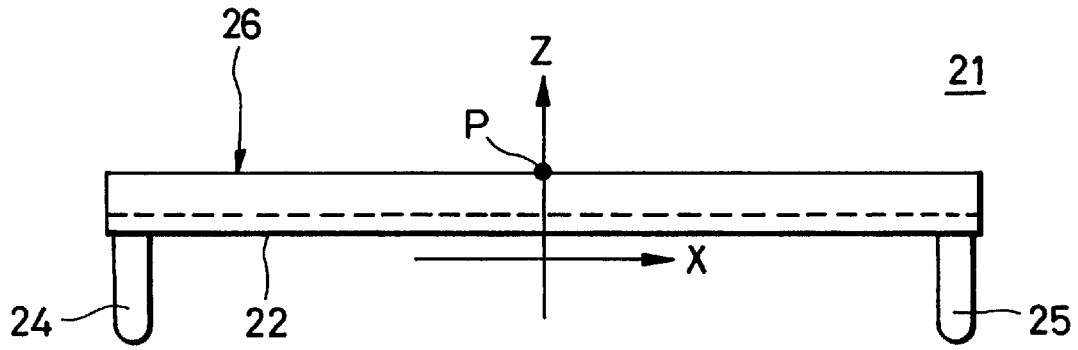
FIG. 4B is a side view showing the example of the color selecting mechanism frame according to the present invention.
Figure 5:
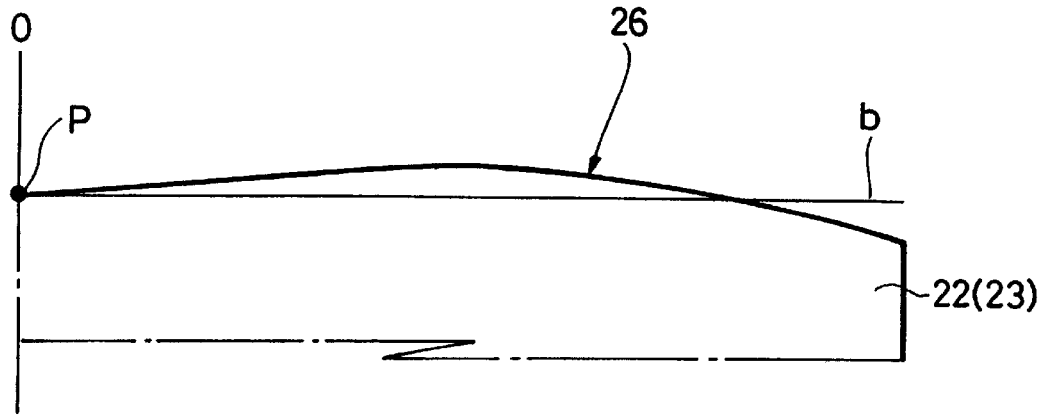
FIG. 5 is a schematic view of a major part of the color selecting mechanism frame according to the present invention.

FIGS. 4A, 4B and 5 (enlarged view of major part) show a frame 21 in a state before the color selecting electrode thin plate according to the present invention is stretched (so-called raw frame).

The frame 21 is a metallic frame comprising, as described above, a pair of the supporting members 22, 23 which oppose each other and a pair of the elasticity applying members 24, 25 which are stretched between the ends of the supporting members 22, 23.

According to this embodiment, after the supporting members 22, 23 of the frame 21 are each shaped so as to have a predetermined curvature with respect to the Y direction and Z direction, by press working or the like, a plane 26 of each of the supporting members 22, 23, on which the color selecting electrode thin plate is to be welded, is formed so as to be a curved surface defined according to five degree expression indicated by Expression 1, by cutting work.

$$Z=A_1x+A_2X^2+A_3X^3+A_4x^4+A_5x^5 \quad \text{[Expression 1]}$$

Examples of $A_1$–$A_5$ are indicated below.

$$A_1=0.00043748\times10^{-4}$$

$$A_2=-1.6684\times10^{-6}$$

$$A_3=8.868\times10^{-8}$$

$$A_4=-6.3059\times10^{-10}$$

$$A_5=5.0294\times10^{-13}$$

Z is a value when the center point P of a welding surface on each of the supporting members 22, 23 in FIG. 4B is assumed to be 0.

Figure 7:
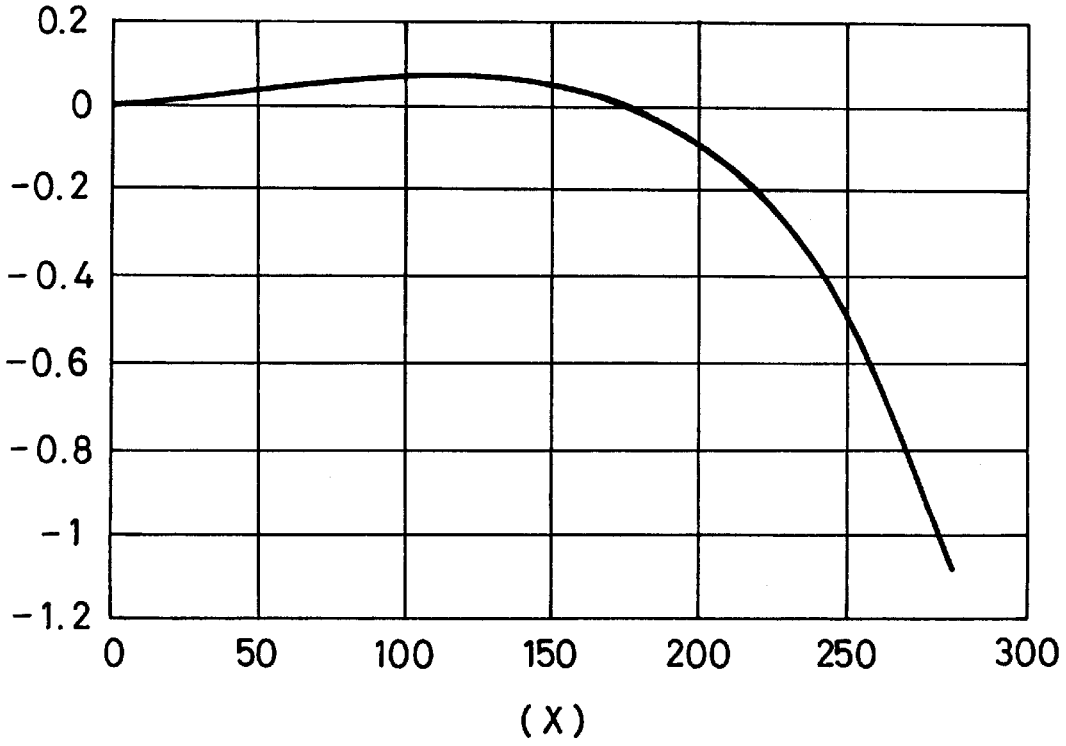
FIG. 7 is a graph showing a curved line of a plane of a the supporting members of the color selecting mechanism frame according to the present invention.

A curve of the plane 26 of the supporting member when its curvature is determined according to the five degree expression indicated in the Expression 1 is shown in FIG. 7. FIG. 5 indicates a shape of the plane 26 of each of the supporting members 22, 23 schematically determined according to FIG. 7.

Meanwhile, although the curved surface is defined by the five degree expression for the reason of an NC machine for use in cutting, any degrees is permissible if it is three or more degrees.

Figure 1:
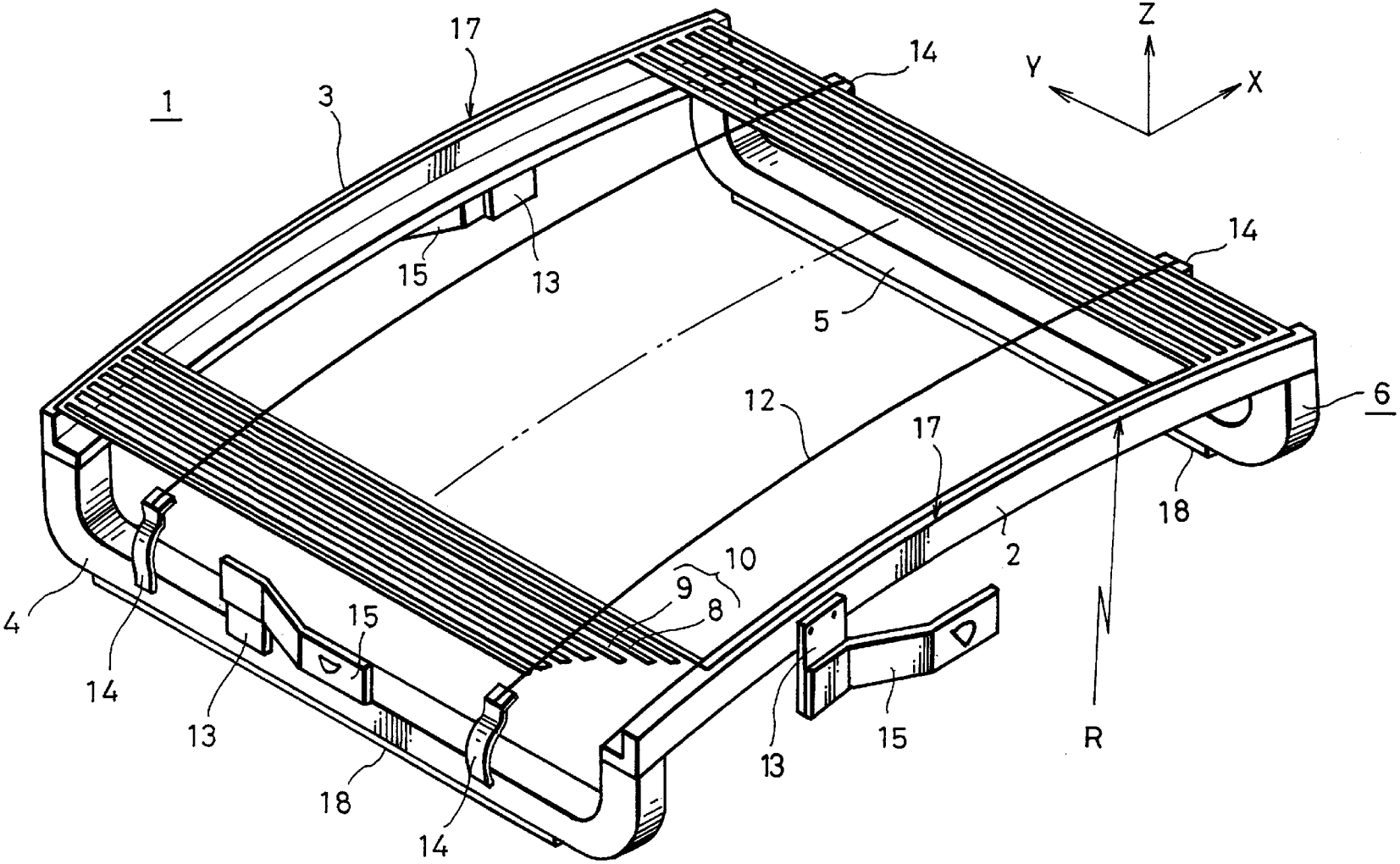
FIG. 1 is a perspective view of a color selecting mechanism.
Figure 2:
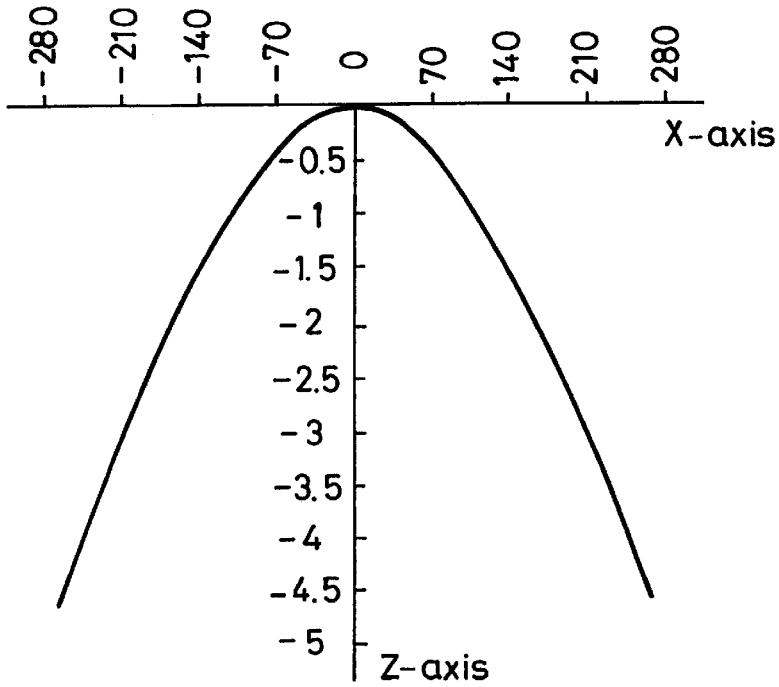
FIG. 2 is a graph showing a curved line in a plane of the color selecting mechanism after darkening, with cutting curve at 15,000 in radius (single radius) according to a conventional example.
Figure 3:
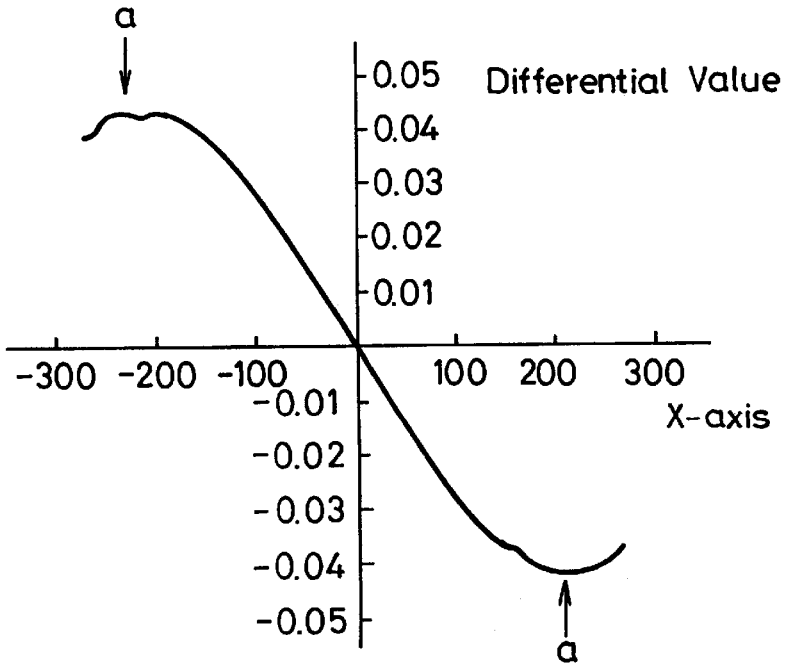
FIG. 3 is a graph indicating differential values of a curved line shown in FIG. 2.
Figure 6A:
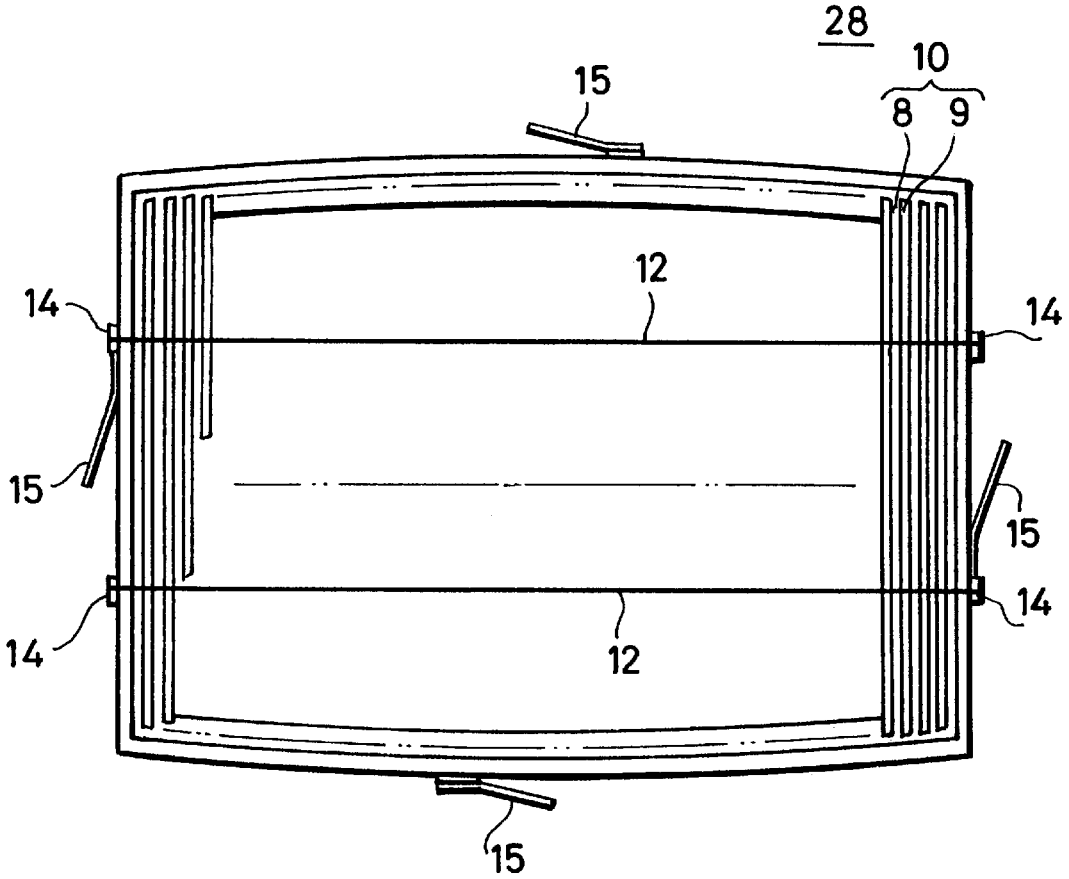
FIG. 6A is a plan view showing an example of the color selecting mechanism according to the present invention.
Figure 6B:
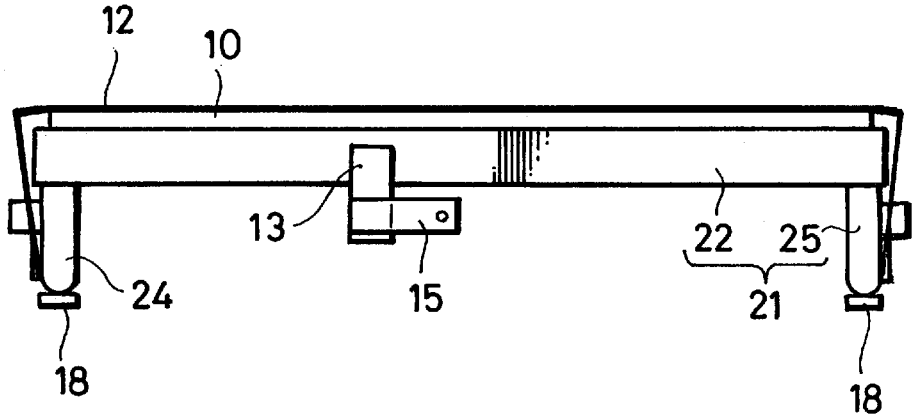
FIG. 6B is a side view showing the example of the color selecting mechanism according to the present invention.

Then, as shown in FIGS. 6A, 6B, the same color selecting electrode thin plate 10 as described above is stretched over the frame 21 having the aforementioned supporting members 22, 23, and darkening is conducted so as to obtain a color selecting mechanism 28. In FIGS. 6A and 6B, the same reference numerals are attached to the same compartments as in FIG. 1 and a description thereof will be omitted.

Figure 8:
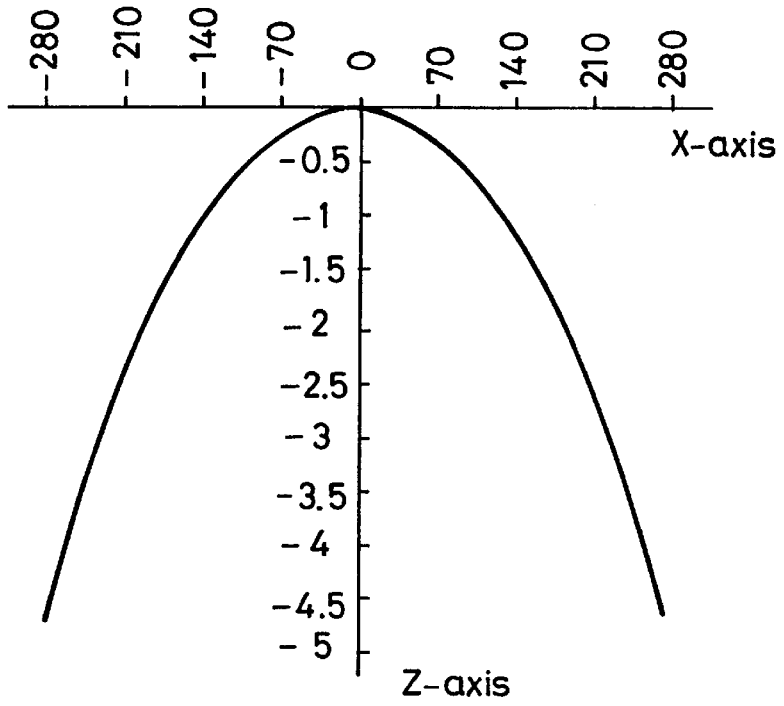
FIG. 8 is a graph showing a curved line of the plane of the color selecting mechanism after darkening, based on cutting curve according to polynomial of the present invention.
Figure 9:
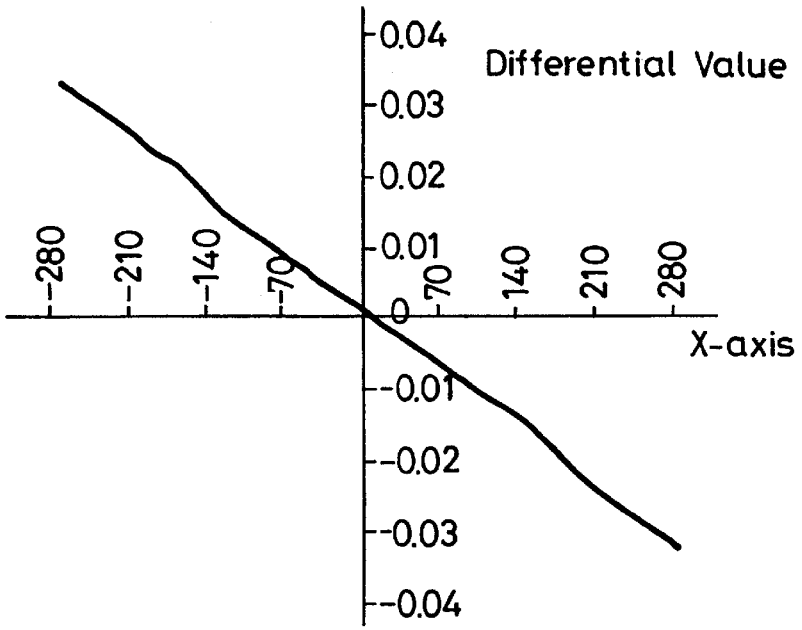
FIG. 9 is a graph showing differential values of the curved line shown in FIG. 8.

The shape of the plane 26 of the frame 21 after darkening, that is, the shape of the plane 26 of each of the supporting members 22, 23 indicates a curved line shown in FIG. 8. In FIG. 8, the axis of abscissa indicates a distance (mm) in the direction x of a screen and the axis of ordinate indicates a distance (mm) in the direction z assuming that the center point P of the surface of each of the supporting members 22, 23 is 0. This curved line has a curvature radius R of about 8000 mm and a differential value thereof shown in FIG. 9 indicates a linear shape.

When the damper wire 12 is stretched, the damper wire 12 is in contact with the entire surface of the color selecting electrode thin plate 10, so as to prevent a vibration thereof.

According to this embodiment, by estimating a displacement which may occur in an interval of time from the state of the raw frame to the state of darkening, the curved line of the plane 26 formed by the supporting members 22, 23 in the raw frame 21 is determined according to the polynomial of the distance X in the horizontal distance, that is, Expression 1, in order to obtain a uniform radius after darkening.

In terms of the shape, the supporting members 22, 23 are produced in the form of a curved surface having at least one point of inflection between the center point and the end portions thereof. The plane 26 of each of the supporting members 22, 23 is determined so as to contain at least one point of inflection in a middle range excluding a range from the center point to 10% the entire length and a range from the end portion thereof to 20% the entire length.

As evident from FIG. 5, the curved surface 26 has a shape which is protruded over a plane b which passes the center point P in the middle range thereof.

Meanwhile, if a configuration in which the damper wire 12 is firmly in contact with the surface in the entire range is secured, there is no problem even if no uniform radius can be obtained after darkening.

According to this embodiment, by assembling the color selecting mechanism 28 by welding the color selecting electrode thin plate 10 using the frame 21 having the curved surface shown in FIG. 7, after darkening, the surface of the frame 21 has uniform or similar radius. As a result, the damper wire 12 can be made to contact entirely the color selecting electrode thin plate 10.

Thus, if the surface of the color selecting mechanism 28 is flattened accompanied by flattening of the cathode-ray tube screen or the radius value of that plane is increased remarkably, the damper wire 12 is not partly floated, so that the damper wire 12 is firmly in contact with the entire surface. As a result, a high reliability flat type color selecting mechanism 28 can be obtained. Thus, a cathode-ray tube whose front panel is very flat can be realized.

The frame according to the present invention is constructed in the form of a curved surface on which the color selecting electrode thin plate is mounted and which has at least one point of inflection between the center portion and the end portions thereof. Consequently, when the color selecting electrode thin plate is attached to the frame to thereby construct the color selecting mechanism, after darkening, the frame has a curved surface having only one curvature or curvatures similar thereto.

Thus, when the curvature radius of the plane of the color selecting mechanism surface becomes very large accompanied by flattening of the cathode-ray tube screen, that is, the color selecting mechanism surface is flattened, the damper wire is not partly floated but the damper wire is firmly in contact with the entire surface. As a result, a high reliability flat type color selecting mechanism capable of suppressing a vibration can be obtained.

Thus, a cathode-ray tube whose front panel is flattened can be realized.

Having described a preferred embodiment of the invention with reference to the accompanying drawings, it is to be understood that the invention is not limited to those precise embodiment and that various changes and modifications could be effected therein by one skilled in the art without departing from the spirit or scope of the invention as defined in the appended claims.

What is claimed is:

1. A cathode-ray tube color selecting mechanism comprising:

a frame formed of members extending in the horizontal and vertical directions of a screen; and a color selecting electrode thin plate which is stretched over said frame and contains a number of slits extending in the vertical direction, wherein said frame includes a plane on which said color selecting electrode thin plate is to be attached, said frame being formed in the form of a curved surface having at least one point of inflection between a center portion and an end portion thereof.

2. A cathode-ray tube color selecting mechanism according to claim 1, wherein a damper wire is stretched in a direction perpendicular (horizontal direction on the screen) to slits in said color selecting electrode thin plate, between the end portions thereof.

3. A cathode-ray tube color selecting mechanism according to claim 1, wherein said curved surface of said plane on which said color selecting electrode thin plate is to be attached, of supporting members extending horizontally, is defined according to the expression:

$$Z=A_1x+A_2x^2+A_3x^3+A_4x^4+A_5x^5.$$

4. A cathode-ray tube color selecting mechanism according to claim 2, wherein a plurality of said damper wire is stretched across one side of said color selecting electrode thin plate.

5. A method of manufacturing a cathode-ray tube color selecting mechanism comprising the steps of:

forming members composing a frame, extending in the horizontal and vertical directions of a screen, so as to have a predetermined curvature in a vertical direction and an axial direction of said tube;

cutting said frame so that a plane on which a color selecting electrode thin plate is to be attached, said frame being a curved surface having at least one point of inflection between a center portion and end portions of said frame;

stretching said color selecting electrode thin plate over said frame and attaching said color selecting electrode thin plate thereto; and darkening the frame over which said color selecting electrode thin plate is stretched by heating.

6. A method of manufacturing a cathode-ray tube color selecting mechanism according to claim 5, wherein said curved surface of said plane on which said color selecting electrode thin plate is to be attached, is defined according to the expression:

$$Z=A_1\,x+A_2x^2+A_3x^3+A_4x^4+A_5x^5$$

in said step of cutting said frame.

7. A method of manufacturing a cathode-ray tube color selecting mechanism according to claim 5, wherein said frame is formed by press working.

8. A method of manufacturing a cathode-ray tube color selecting mechanism according to claim 5, wherein said color selecting electrode thin plate is attached to said frame by welding.

9. A method of manufacturing a cathode-ray tube color selecting mechanism according to claim 5, further comprising the step of attaching a damper wire stretched across an entire length of said color selecting electrode thin plate, whereby said damper wire is in contact with said color selecting electrode thin plate over its entire length.

10. A method of manufacturing a cathode-ray tube color selecting mechanism according to claim 5, wherein a plurality of said damper wire is stretched across one side of said color selecting electrode thin plate.

* * * * *